United States Patent [19]

Levine

[11] Patent Number: 4,814,779

[45] Date of Patent: Mar. 21, 1989

[54] RADAR SYSTEM WITH AUXILIARY SCANNING FOR MORE DWELL TIME ON TARGET

[75] Inventor: Arnold M. Levine, Chatsworth, Calif.

[73] Assignee: ITT Gilfillan, a division of ITT Corporation, Van Nuys, Calif.

[21] Appl. No.: 30,010

[22] Filed: Mar. 25, 1987

[51] Int. Cl.[4] ..... H01Q 3/14

[52] U.S. Cl. ..... 343/754; 343/758; 343/771; 342/375

[58] Field of Search ..... 343/753, 757, 754, 761, 343/911 R, 910, 758, 853, 770, 772, 771, 778, 768, 368, 371, 374, 375, 762, 765

[56] References Cited

U.S. PATENT DOCUMENTS

| | | | |
|---|---|---|---|
| 2,576,146 | 11/1951 | Ruze et al. | 343/754 |
| 4,119,971 | 10/1978 | Stark | 343/771 |
| 4,642,651 | 2/1987 | Kuhn | 343/754 |
| 4,675,681 | 6/1987 | Kinsey | 343/771 |

OTHER PUBLICATIONS

Frank, "Discrete-Beam Phased Array", Microwave Journal, Oct. 1977, pp. 31–33.

Hidaka, "Image Reconstruction by Using a Frequency-Sweep Method", Journal of Applied Physics, vol. 46, No. 2, Feb. 1975, pp. 786–790.

*Primary Examiner*—William L. Sikes

*Assistant Examiner*—Michael C. Wimer

*Attorney, Agent, or Firm*—Robert A. Walsh; Thomas N. Twomey; Mary C. Werner

[57] ABSTRACT

A radar system with auxiliary scanning provision for providing more dwell time on target, the system having a main frequency scan antenna with electronic or mechanical arrangements for auxiliary scanning. In the electronic embodiment, a space fed phased-array auxiliary antenna is provided, the radiating elements being interconnected with diode phase shifters, which are electronically actuated and synchronized to the antenna rotation. In the mechanical embodiment, a multi-sided prism arrangement in front of the antenna rotates in synchronism in a counter direction to the antenna, with auxiliary scanning data electronically manipulated for processing.

10 Claims, 7 Drawing Sheets

RADAR SYSTEM WITH AUXILIARY SCANNING FOR MORE DWELL TIME ON TARGET

BACKGROUND OF THE INVENTION

The background of the invention will be discussed in two parts:

1. Field of the Invention

This invention relates to frequency scanned radar antennae, and more particularly to a radar antenna having a scan back system which provides for more dwell time on the target.

2. Description of the Prior Art

In radar scanning systems, some such systems employ antennae that are mechanically rotated in azimuth and frequency-scanned in elevation to provide three-dimensional aircraft or target object position data. The antennae in such systems employ a number of spaced radiating elements, preferably in a fixed array, with some form of delay means in the line feeding the radiating element. For frequency scanning, a wave front is generated by the radiating elements in a given direction, that is, at a pointing angle, with the wave front corresponding to a line in a space along which the signals emanating from the radiating elements are in phase with one another. The phase coincidence from one element to another is controlled by the interconnecting delay means, such as a tapped delay line, or slow wave structure, that may be folded, helically wound, or dielectrically loaded in form. The folded form is called a serpentine.

In such systems, volumetric aerial coverage may be obtained by radiating an orderly progression of sequentially generated transmitter signals, each at a different RF frequency as the antenna rotates. In such systems, the dwell time on target is a direct function of the speed of rotation of the antenna and the beam pattern, in both planes, of the radiating elements of the antenna. For low flying, line of sight, high speed targets, some difficulty is encountered, primarily due to the pencil beams used in such systems, coupled with the rate of scanning.

It is accordingly an object of the present invention to provide a new and improved radar system.

It is another object of the present invention to provide a new and improved radar system with provision for scan back, forward or both from an auxiliary antenna for enabling more dwell time on target.

It is still another object of the present invention to provide a new and improved antenna system using an auxiliary space fed array antenna with diode phase shifters to provide more dwell time on target.

It is a further object of the present invention to provide a new and improved antenna system utilizing a counter-rotating multi-sided prism to provide more dwell time on target.

SUMMARY OF THE INVENTION

The foregoing and other objects are accomplished by providing a scan system for a frequency scan antenna, in which auxiliary scanning means are provided for mounting forward of the main antenna, for providing a secondary beam of less energy useful for line of sight low flying target detection. In one embodiment electronic scanning means are provided by use of an auxiliary space fed phased array antenna which is electronically tiltable, with the system electronics modified for enabling the sweep of the auxiliary antenna to be in synchronism with the rotating speed of the main antenna while continuing to track a target. In a second embodiment, a mechanical scan arrangement is disclosed utilizing a rotating multi-sided prism forward of the main antenna rotating on an axis in the plane of the axis of rotation of the main antenna for utilization of the radar energy of the beam to scan a portion of the target area outside of the main beam to obtain more hits on a target.

Other objects, features and advantages of the invention will become apparent from a reading of the specification, when taken in conjunction with the drawings, in which like reference numerals refer to like elements in the several views.

DESCRIPTION OF THE PREFERRED EMBODIMENT

Figure 1:
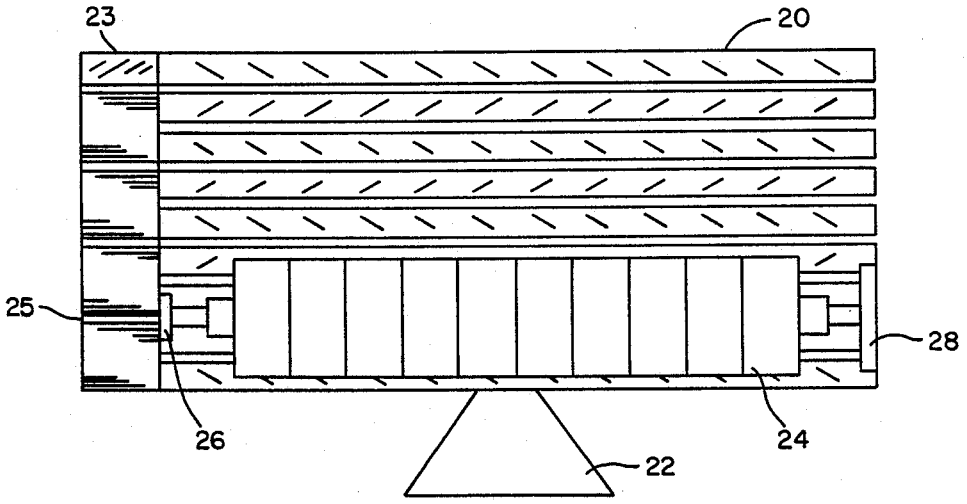
FIG. 1 is a diagrammatic front view of a scan back antenna system according to the invention, a preferred embodiment using a space fed phased-array antenna with diode phase shifters, mounted forward of the main frequency scan antenna.

Referring now to the drawings, and particularly to FIGS. 1 through 4, there is shown an antenna system, including a frequency scan main antenna, generally designated 20, mounted for rotation about a vertical axis through means of an antenna mounting drive system 22. The antenna 20 is depicted as a folded form frequency scan antenna, fed through a serpentine waveguide 23. Scanning in the azimuth is effected by rotation of the antenna 20 by means of the motor drive system 22 about a vertical axis 21. The support structure for antenna 20 is not illustrated for simplicity. As is conventional with such antenna systems, the speed of rotation is uniform or regulated with scanning on the vertical axis or elevation being accomplished electronically by frequency scanning, thus providing three-dimensional aircraft or target position data. With such antenna systems, the speed of rotation is usually high and the beam width is very narrow, with the dwell time on "target" being inversely proportional to both speed of rotation and beam width. As a consequence, after the target is outside the beam, additional information on the target must wait until the next sweep of the antenna 20 for updating. Basically with such antenna systems, the problem related to dwell time on target sufficient for target identification and tracking is not that serious for slow speed medium altitude long range airborne targets.

In present day frequency scanned radar systems, a "pencil" beam is formed, particularly in the plane of frequency scanning, with a beam angle lying between one-half degree to five degrees, and more commonly at the lower end of the range. In the azimuth plane, with scanning effected by mechanical rotation, the beam angle may be broader. Such pencil beams are important for accurate position data. With low flying targets at line of sight range, with a "pencil" beam, the problem of rapid target identification becomes particularly acute.

In accordance with the present invention, scan back means 24 are provided for mounting forward of the main antenna 20, and for utilizing a small portion of the energy of the main antenna for the operation thereof. In one embodiment electronic scan back means are provided by use of an auxiliary space fed phased-array antenna 24 which is electronically tiltable, with the system electronics modified for enabling the sweepback of the auxiliary antenna to be in synchronism with the rotating speed of the main antenna 20. In a second embodiment, a mechanical scan back arrangement is disclosed utilizing a counter-rotatable multi-sided prism 100 (see FIGS. 8–10) forward of the main antenna 20 rotating on an axis in the plane of the axis of rotation of the main antenna 20 for utilization of the radar energy of the beam to scan a portion of the target area behind the main beam, that is, the area in time relation rearwardly of the pointing angle of the main beam.

Figure 2:
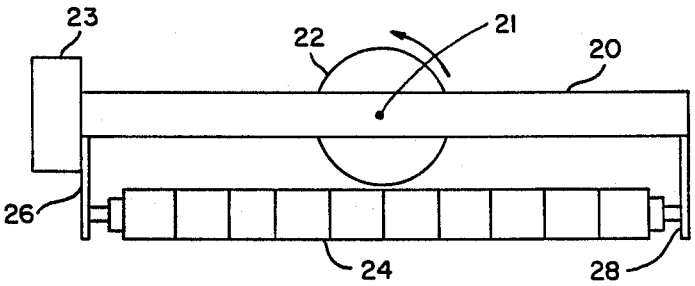
FIG. 2 is a top plan view of the antenna system of FIG. 1.
Figure 3:
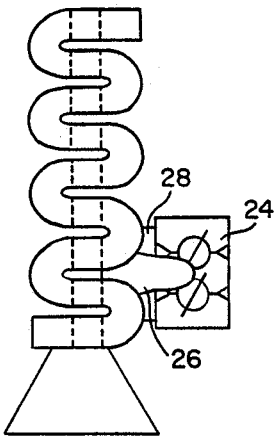
FIG. 3 is a side elevational view of the antenna system of FIG. 1.

As shown in FIGS. 1 through 3, an auxiliary antenna 24 is provided by mounting horizontally to a pair of arms 26 and 28 attached at the lower end of the front of the main antenna 20. The attachment is such that the plane of the auxiliary antenna 24 lies generally parallel to the plane of the main antenna 20. The auxiliary antenna 24 is a space fed phased-array antenna of narrow vertical dimension, and horizontal dimension approximating that of the width of the main antenna 20 and is fed from the portion of the main antenna lying directly behind it. Since the geometry of the array of an antenna, in part, and the desired tracking range determines the power requirements, with a smaller antenna 24 mounted forward of the main antenna 20, a small part of the total energy requirements of the system may be used for the auxiliary antenna 24. It is to be understood that the configuration, dimensions and position of the auxiliary 24 are selected for non-interference with the primary portion of the main antenna 20. For coupling to the antenna control system, the auxiliary antenna 24 is provided with a digital switch input connector, generally designated 25 for coupling to the digital switch controls. Though FIG. 3 shows the antenna vertical, as is well known in practice, it is normally tilted.

Figure 4:
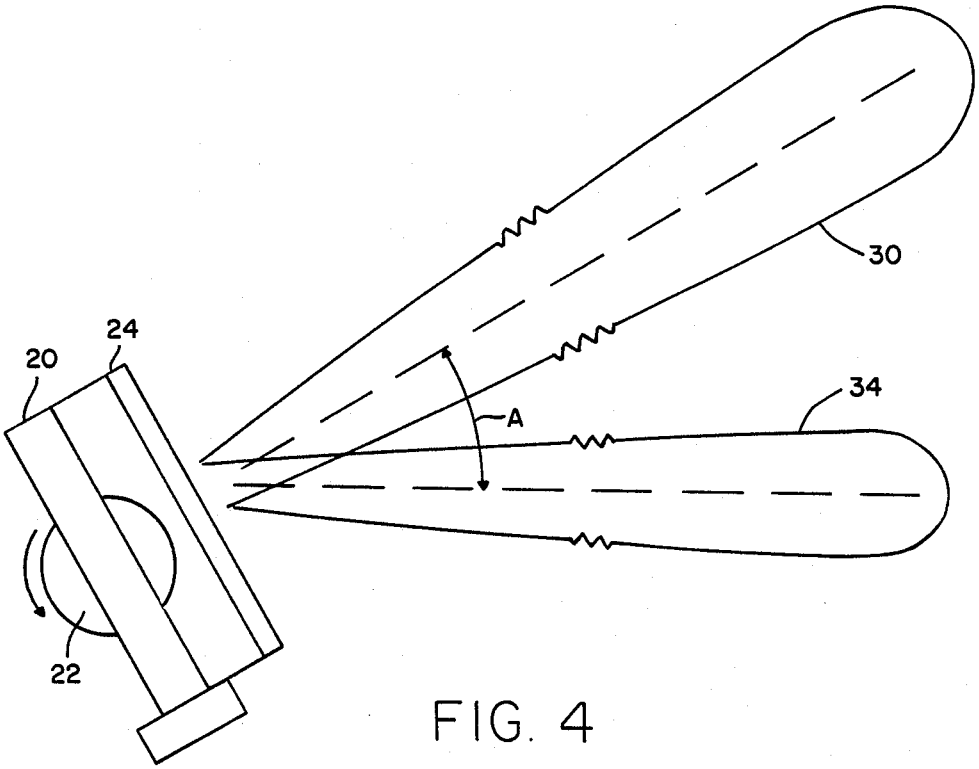
FIG. 4 is a diagrammatic plan view of the antenna beams emanating from the antenna system of FIG. 1.

By reference to FIG. 4, as the main antenna 20 is rotating in a counterclockwise direction, the direction of the radar beam 30 therefrom lies in a direction generally perpendicular to the plane of the main antenna 20. A second radar beam 34 is emitted from the auxiliary antenna 24 in a direction for scanning through an angle disposed, in time relation, rearwardly of the main beam 30. The angular difference in pointing angles is determined in relation to the beam angle of the main beam 30 and in relation to the speed of rotation of the main antenna 20. In a phase-frequency scanning antenna, such as auxiliary antenna 24, the phasing between elements may be digitally controlled to selectively and controllably scan a portion of the target area in azimuth behind the main beam 30, with frequency control of the elevational scan.

Figure 5:
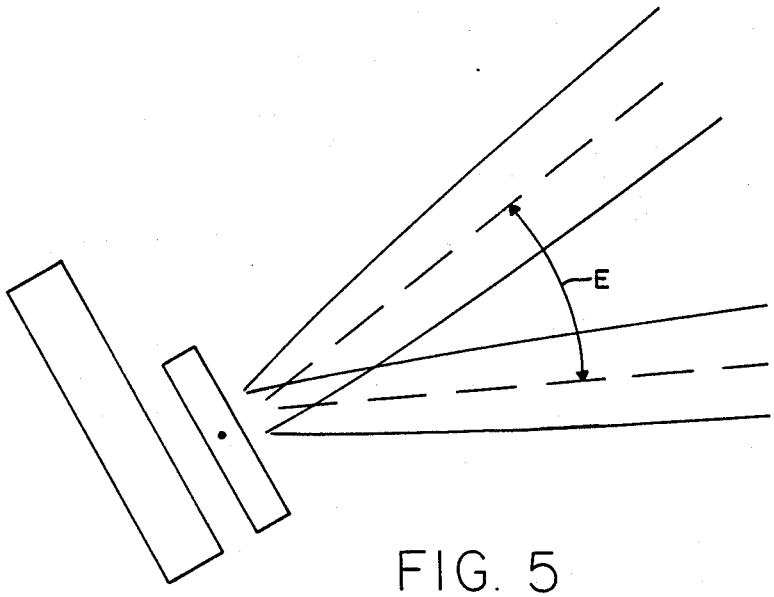
FIG. 5 is a diagrammatic side view of the antenna of FIG. 4 illustrating the tilting of the scan back beam relative to vertical.

As shown in FIG. 4, the angle designated "A" between the main beam 30 and the auxiliary beam 34 varies during the scan back of the auxiliary antenna 24, thus enabling the beam 34 to remain on target for an additional dwell time after passage of the main beam 30 during rotation of the antenna 20. Also, as depicted in FIG. 5, on an elevational plane, the auxiliary antenna is controlled by phase scanning through an angle "E" smaller than the total angle of scan of the main beam 30 (typically approaching ninety degrees). This beam formation and scanning of the auxiliary beam 34 enables low level tracking, and is especially suited for low over the water tracking.

With the control of the main antenna 20 and auxiliary antenna 24 effected through the same control circuitry, synchronism may be established whereby the low flying line of sight target is displayed for an interval longer than possible with the main beam 30 alone, thus providing more dwell time on target for such targets of particular importance. By reference to FIG. 6, there is shown, in block diagram form, a system depiction of controls required for effecting synchronization of the sweepback of the auxiliary beam 34 with the speed of the rotation of the main antenna 20, and for the display to obtain the backscan information in proper time relation, and for proper sawtooth scan arrangement. For this purpose, signals from the main antenna 20 are transmitted through a low angle receiver 40, which includes means for discriminating signals indicative of low flying targets within a certain elevational angle by keying on low angle receiver 40 for desired ranges in conjunction with information from the main radar tracking signal from tracking signal input 59 via scan refresher 60. These signals are transmitted to a signal processor 42 for further processing, and from which the signals are appropriately displayed on the display 44.

The processing includes means for providing information on target angle as well as tracking data, depicted by blocks 46 and 48, which include automatic angle correction and automatic tracking correction, respectively. This information is then utilized to control the energization of the auxiliary antenna 24 through a low beam tracking control 50 and a digitally controlled phase switching system 52, both of which have outputs to the auxiliary antenna 24 for effecting control of the beam 34 by phase scan in the elevational plane and phase-controlled scan in the azimuth plane, respectively.

However, inasmuch as control of the beam of the auxiliary antenna 24 must be accomplished with relation to speed of rotation of the main antenna 20, the alternating current antenna drive 54 is constantly monitored through a scan rate multiplier 56 which provides a constantly updated input to the switching system 52 as a necessary condition to the speed of operation of the switching system 52. The switching system 52 provides an output to a multiple angle position indicator 58, which in turn provides outputs to both update the display 44 and provide a signal to a scan refresher system 60 which utilizes time division signal multiplexing for scan refresh.

Figure 7:
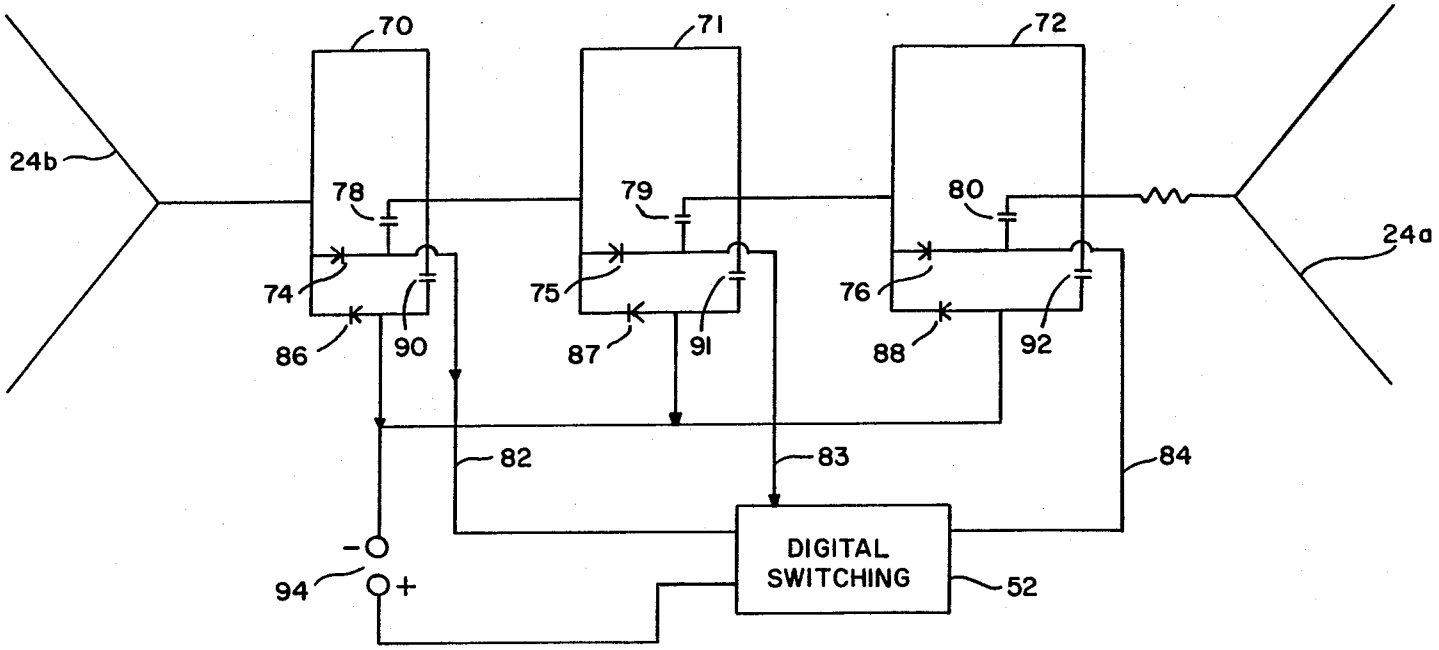
FIG. 7 is a circuit diagram of the diode phase shifting arrangement for the phased-array antenna of the system of FIG. 1.

However, with common control means, safeguards are necessary to insure operation of the main antenna in case of power failure of the control system of the auxiliary antenna 24. By reference to FIG. 7, there is shown a diode phase-shifting arrangement which includes a failsafe provision for shorting out the phase shifting means, thus enabling proper operation of the antenna system, excluding, of course, the scan back operation. In FIG. 7 one array of the antenna 24 is depicted with a number of capacitor-coupled delay lines 70–72 (three being shown, with each being longer than the preceding line) in series with opposite ends 24*a* and 24*b* thereof. As is conventional in phased array antennas, beam pointing angle is controlled by the phase angle of the beam signal, which in turn is controlled by the amount of delay in the line. To effect the scan, one or more of the delay lines 70–72 is shorted by suitable digitally controlled switching diodes 74–76, each of which is connected in series with capacitor 78–80, to act as a shunt across the respective delay line 70–72, when the respective switching diode 74–76 is rendered conductive by an appropriate signal over leads 82–84 from the digital switching system 52. It is to be understood that the values of the capacitors 78–80 are selected for acting as a short circuit in response to RF transmission frequencies within the range of frequencies of operation of the antenna system.

However, with such switching diode phase shifting arrangements, in the event of power failure of the auxiliary antenna 24 control system, the switching diodes 74–76 would all be rendered non-conductive, in which event, all of the delay lines 70–72 would remain in the circuit, thus providing a constant phase shift angle which would serve no useful purpose since scan back would thus be eliminated. To guard against this event, back-biased diodes 86–88 in series with capacitors 90–92 are connected in parallel reverse coupled relation with the switching diodes 74–76 and their respective capacitors 78–80. By reverse-coupling, the cathode of each of the back bias diodes 86–88 is coupled directly to the anode of the switching diodes 74–76. Back bias is applied to all back bias diodes 86–88, from a constant direct current source 94 which is powered by the same power source as the switching system 52. This back bias effectively prevents conduction through the back bias diodes 86–88 so long as power is available. With the switching diodes 74–76 (with their respective capacitors) effectively in parallel with the back bias diodes 86–88 (with their respective capacitors), switching control signals from the switching system over leads 82–84 render the switching diodes 74–76 selectively conductive to thus control the phase. However, in the event of power failure, the back bias drops off. Similarly, the switching signals for the switching diodes 74–76 are no longer present. In this instance, with the parallel oppositely conducting paths provided, conduction in a first direction at RF frequencies during a first half-cycle is obtained through one of the diodes, with conduction in the opposite half-cycle of the RF signal taking place through the other diode. As a result, all of the delay lines 70–72 for each array are shorted, thus appearing as a direct link. In case of complete failure both diodes would thus alternately conduct so that the phase switching system would be shorted and the antenna system would operate normally.

Figure 8:
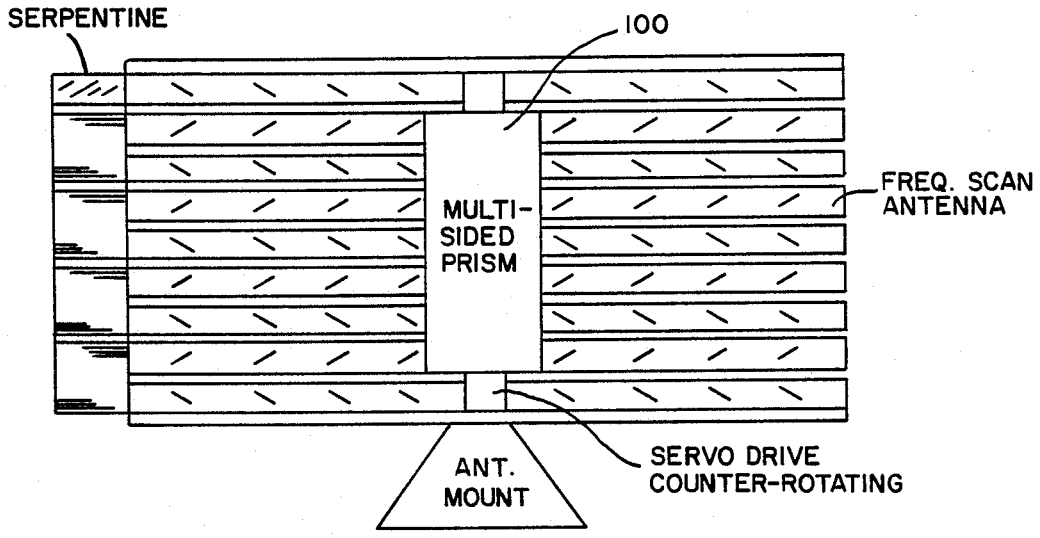
FIG. 8 is a front view of an alternate embodiment of a mechanical scan back system according to the invention utilizing a counter-rotating multi-sided prism mounted forward of the main antenna.
Figure 9:
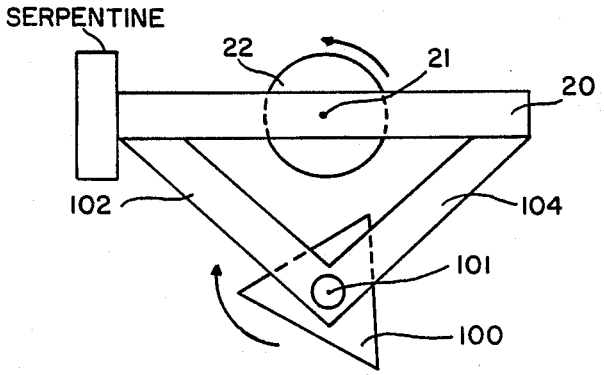
FIG. 9 is a top plan view of the system of FIG. 8.
Figure 10:
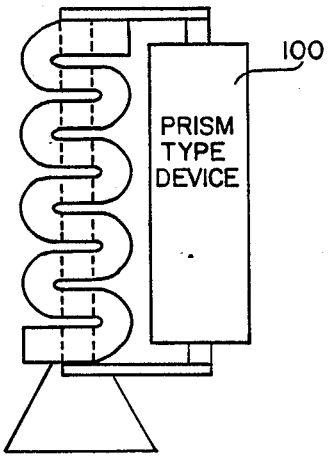
FIG. 10 is a side elevational view of the system of FIG. 8.

Referring now to FIGS. 8 through 10, there is shown an alternate embodiment of a scan back system wherein a counter-rotating multi-sided prism 100 is secured forward of the main antenna 20, and positioned for rotation on an axis 101 generally parallel to the axis of rotation 21 of the antenna 20. Structurally, the main antenna 20 is provided with parallel pairs of divergent arms, such as upper arms 102 and 104 shown in FIG. 9, having the first ends thereof secured together and the opposite ends thereof suitably secured at the corners of the main antenna 20. The juncture of the arms 102 and 104 provides the upper pivot for the axis of rotation 101 of the prism 100. A lower set of correspondingly configured and positioned arms provide rotatable support for the prism 100. As depicted in the drawings, the prism 100 is shown as a three-sided prism of equilateral triangle configuration in cross-section. However, it is to be understood that the prism 100 may have any number of sides, such as sixteen sides for example, with a regular geometric cross-section, wherein the surface of each side is equal and the angle between adjacent sides is equal. In all instances, the axis of rotation 101 is on the geometric center of the prismatic solid.

In prismatic solids, the deviation of a beam of electromagnetic energy passing therethrough is a function of the refractive index of the prism and the frequency of the electromagnetic energy wave. The higher the frequency, the less the deviation for a given index of refraction. Furthermore, the amount of deviation is determined by the angle of incidence of the beam relative to the face of the prism upon entering.

Figure 11:
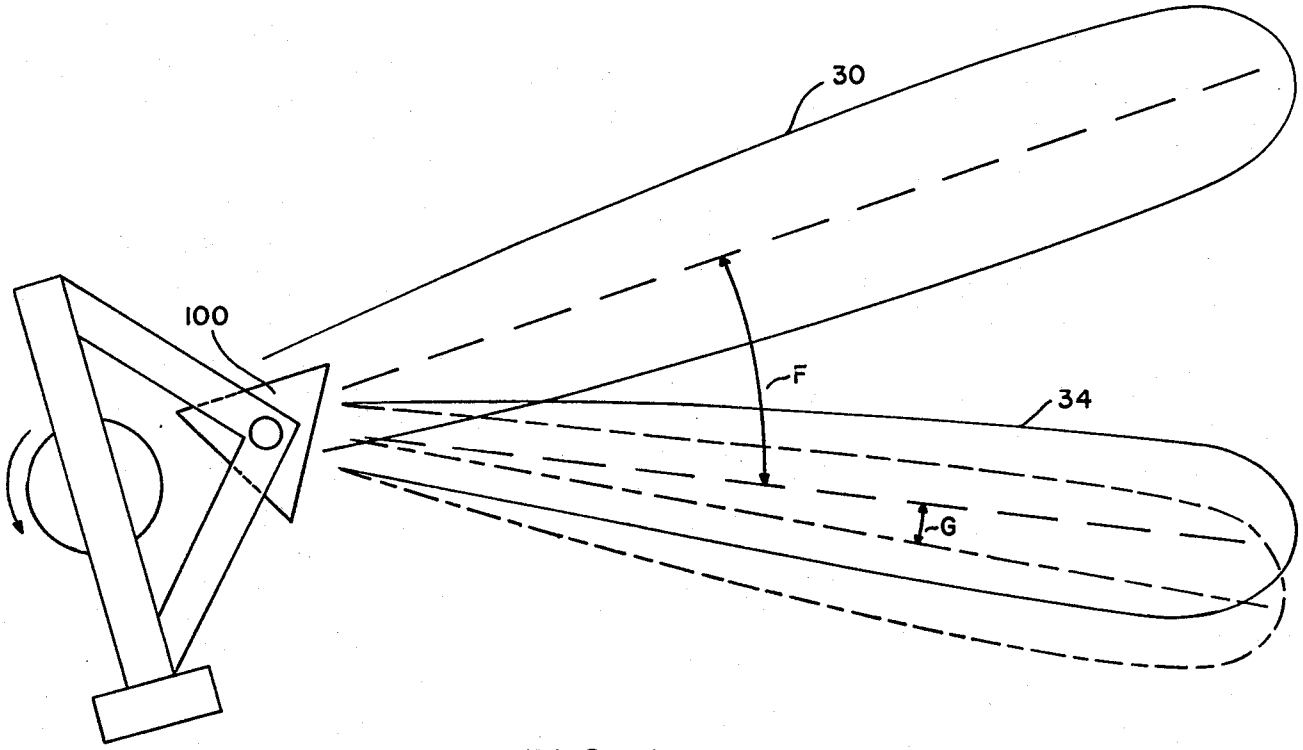
FIG. 11 is a diagrammatic horizontal view of the radar beams emanating from the system of FIG. 8.

The difference between the operation of the scan back feature in this embodiment from the first embodiment resides in the manner that the angle F between the main beam 30 and the scan back beam 34, as shown in FIG. 11, varies. With the prism 100 the scan back beam 34 follows the main beam 30 while oscillating through a smaller angle G. The effect of this is that as the main beam 30 travels over an angle which varies depending upon the size of the target and the parameters of the prism 100, the scan back beam 34 will lose the target and move into a position to acquire a new target.

Figure 6:
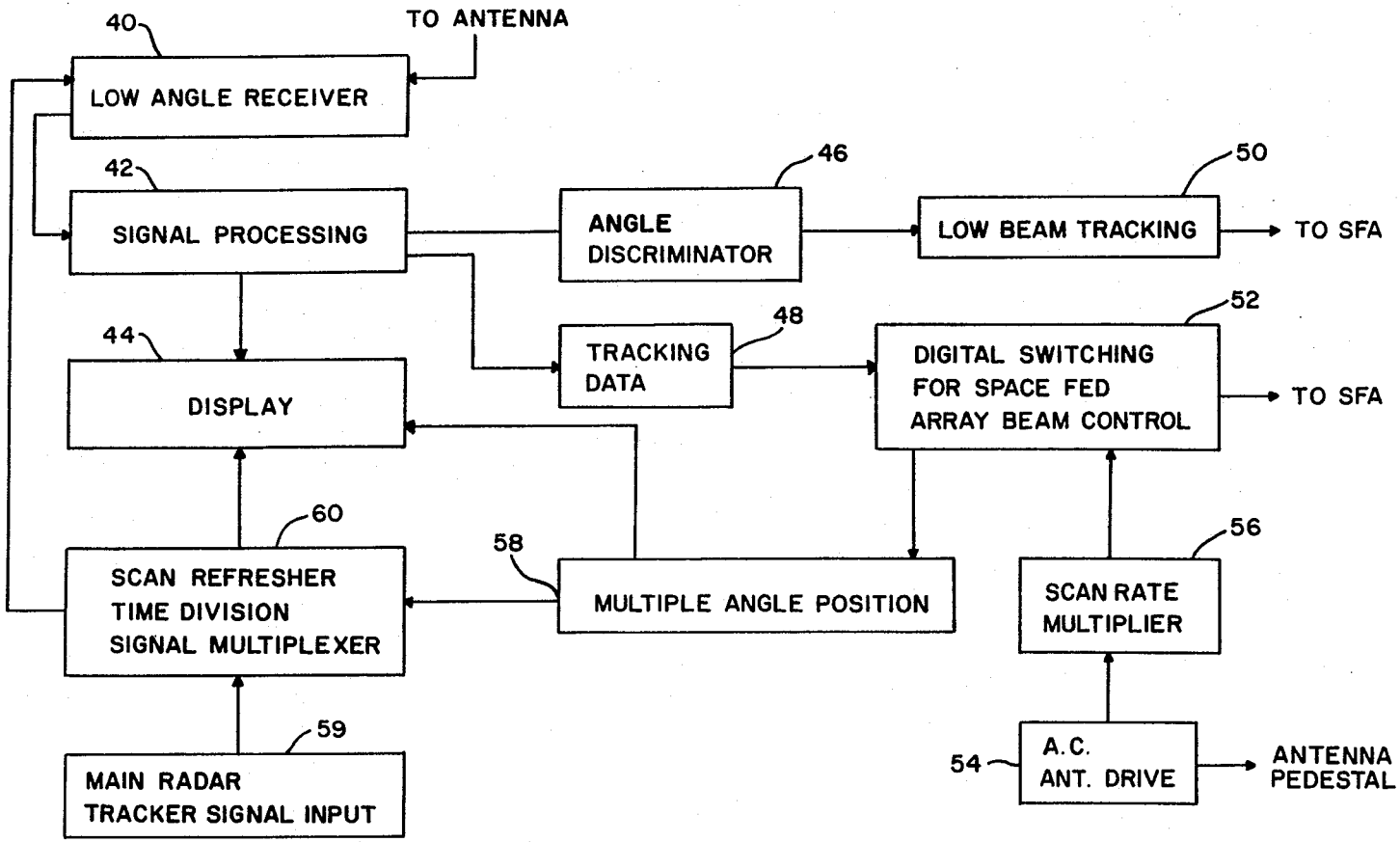
FIG. 6 is a block diagram of the modification to the system for operation of the space fed phased array antenna used in the system of FIG. 1.
Figure 12:
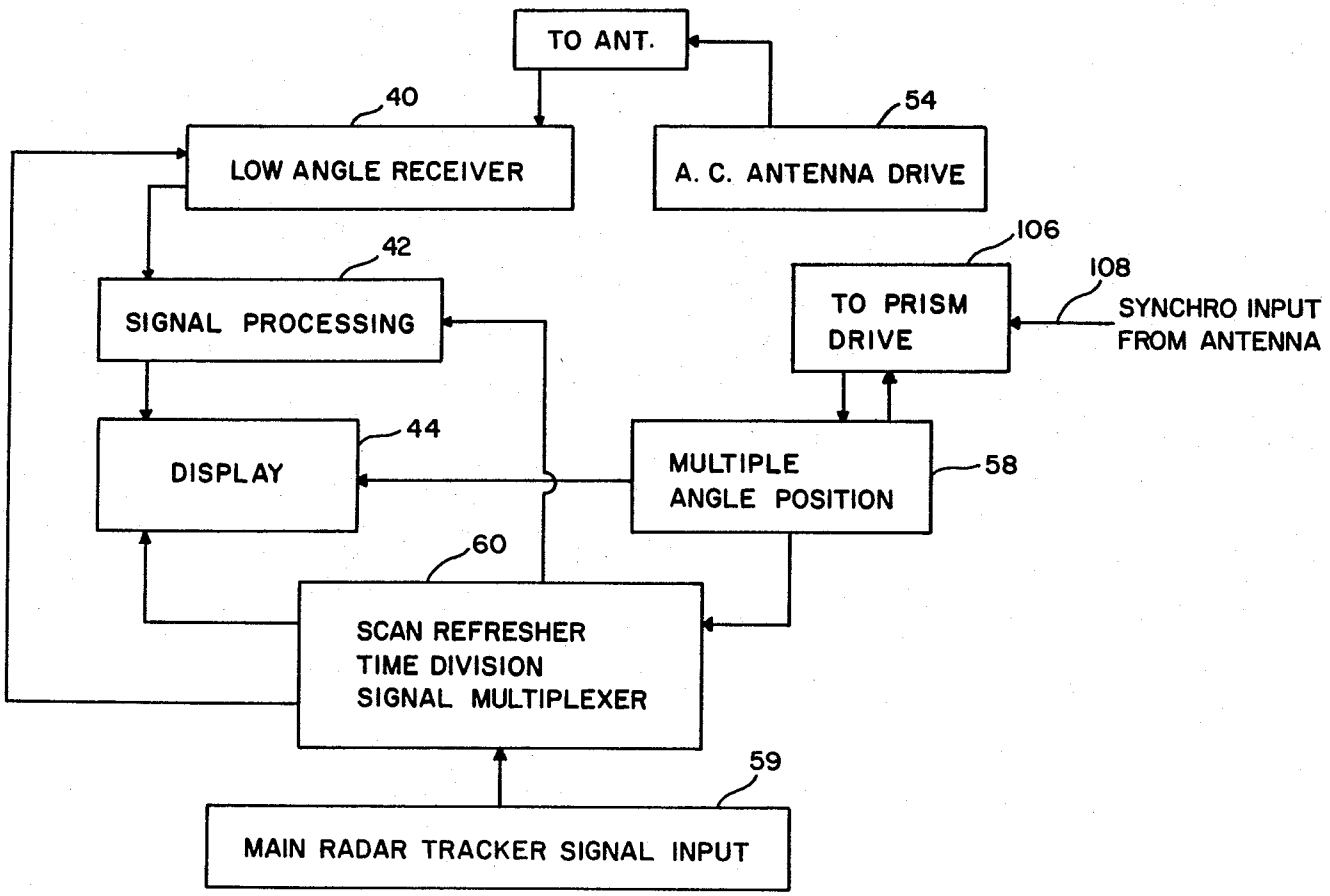
FIG. 12 is a block diagram of the system of FIG. 8.

Turning to FIG. 12, the block diagram of the embodiment of FIGS. 8–10 can be seen to be less complex than that of the first embodiment illustrated in FIG. 6. The only additional element in FIG. 12 is the prism drive 106 which is fed by a synchro input 108 from the antenna to control the phase difference between the counter-rotating prism 100 and the main beam.

In this embodiment the deviation of the angle between the scan back beam and the main beam is fixed and cannot be varied in the manner of the first embodiment.

Since the principles of the invention have now been made clear, modifications which are particularly adapted for specific situations without departing from those principles will be apparent to those skilled in the art. For instance, it is possible to scan forward with the auxiliary antenna rather than backward. This can be done in the prism embodiment for instance by rotating the prism in the same direction as the antenna rather than in the opposite direction. It can also obviously be done in the electronic embodiment by pointing ahead of the main beam. Since the auxiliary antenna is lower power, initial acquisition may not be as positive, however, dwell time on target will be extended. Auxiliary scanning can also obviously be done on both sides of the main radar beam with appropriate modification which will be obvious to one skilled in the art. The appended claims are intended to cover such modifications as well as the subject matter described and to only be limited by the true spirit of the invention.

I claim:

1. A radar antenna system comprising:

a main fixed array antenna;

means for rotating said main antenna in a given direction of rotation about a generally vertical axis for providing a main radar beam for scanning in azimuth;

means for electronically frequency scanning the array of said main antenna for scanning said main radar beam in elevation during the rotation of said main antenna;

auxiliary scanning means mounted forward of said main antenna for rotation with said main antenna, said auxiliary scanning means including means for angularly directing another radar beam through a scan angle at least partially outside of the pointing angle of said main radar beam; and other means interconnecting said means for rotating and said auxiliary scanning means for synchronizing the operation of said another radar beam to said main radar beam for enabling more dwell time on a particular target as a consequence of said another radar beam.

2. The radar antenna system according to claim 1 further including display means and wherein said other means includes means for tracking the position of the pointing angle of said another radar beam relative to said main radar beam for enabling positional display of a particular target relative to said main beam.

3. The radar system according to claim 1 wherein said auxiliary scanning means includes a space fed phased array auxiliary antenna system.

4. The radar system according to claim 3 wherein said space fed phased array auxiliary antenna system includes means for maintaining said another radar beam on a target for a time after said main radar beams loses the target.

5. The radar system according to claim 1 wherein said auxiliary scanning means includes a multi-sided prism means mounted for rotation in a direction opposite to the direction of rotation of said main antenna for scan back.

6. The radar antenna system according to claim 5 wherein said prism means is mounted centrally relative to said main antenna and rotates on an axis extending through the plane of the axis of rotation of said main antenna.

7. The radar antenna system according to claim 6 wherein the counter rotation of said multi-sided prism means is synchronized with the rotation of said main antenna such that said auxiliary scanning means tracks a particular target over an angle which oscillates and follows the main beam to increase the dwell time on said target.

8. The system of claim 1 in which the auxiliary scanning means is a scan forward means including means for angularly directing said another radar beam through a scan angle forwardly.

9. The system of claim 1 in which said auxiliary scanning means includes a multi-sided prism means mounted for rotation in the same direction as the direction of rotation of said main antenna for scan forward.

10. The system of claim 5 in which said auxiliary scanning means includes a multi-sided prism means angularly positioned and rotated to scan through said main beam and on both sides thereof for enabling more dwell time on target.

* * * * *